US006234763B1

(12) United States Patent
Ota et al.

(10) Patent No.: US 6,234,763 B1
(45) Date of Patent: May 22, 2001

(54) VARIABLE DISPLACEMENT COMPRESSOR

(75) Inventors: Masaki Ota; Kenta Nishimura; Hirotaka Kurakake; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/443,263

(22) Filed: Nov. 22, 1999

(30) Foreign Application Priority Data

Nov. 27, 1998 (JP) ..... 10-336968

(51) Int. Cl.[7] ..... F04B 1/26
(52) U.S. Cl. ..... 417/222.2; 417/61.5
(58) Field of Search ..... 417/222.2; 251/61.5, 251/129.18, 129.02, 129.07, 129.15; 335/255

(56) References Cited

U.S. PATENT DOCUMENTS 6,010,312 * 1/2000 Suitou et al. ..... 417/222.2
6,036,447 * 3/2000 Kawaguchi et al. ..... 417/222.2
6,146,106 * 11/2000 Suitou et al. ..... 417/222.2

FOREIGN PATENT DOCUMENTS 8-338364 12/1996 (JP) .

* cited by examiner

*Primary Examiner*—Teresa Walberg
*Assistant Examiner*—Jeffrey C Pwu
(74) *Attorney, Agent, or Firm*—Morgan & Finnegan, LLP

(57) ABSTRACT

A variable displacement compressor the displacement of which is externally controlled is provided. The compressor has basically the same structure as prior art compressors except for simple differences. A pressure sensing chamber of a displacement control valve is connected to a suction chamber by an outlet passage. A bellows is located in the pressure sensing chamber. The bellows expands and contracts in accordance with the pressure in the sensing chamber. A valve chamber forms part of a displacement control passage, which is used to control the pressure of a crank chamber. A valve body is located in the valve chamber. The valve body is moved by the bellows to open and close the displacement control passage. Highly pressurized gas from the discharge chamber is supplied to the pressure sensing chamber through an inlet passage. The gas in the pressure sensing chamber is released to the suction chamber through the outlet passage. An electromagnetic valve is located in the outlet passage to regulate the flow of refrigerant gas from the sensing chamber. The outlet passage also includes a bypass passage. The bypass passage bypasses the electromagnetic valve and constantly communicates the pressure sensing chamber with the suction chamber.

19 Claims, 7 Drawing Sheets

VARIABLE DISPLACEMENT COMPRESSOR

BACKGROUND OF THE INVENTION

The present invention relates to a variable displacement compressor used in a vehicle air conditioning system, and more specifically, to a variable displacement compressor that has a displacement control valve for controlling the displacement of the compressor.

A variable displacement compressor used in a vehicle air conditioning system is driven by a vehicle engine. The displacement, or cooling performance, of the variable displacement compressor is automatically controlled based on cooling load. A swash plate type variable displacement compressor has a swash plate located in a crank chamber. The inclination of the swash plate is altered by controlling the pressure in the crank chamber with a specially designed control valve. Altering the swash plate inclination changes the stroke of pistons, which varies the displacement of the compressor. The specially designed control valve can be an internally controlled valve or an externally controlled valve.

An internally controlled control valve includes a pressure sensing mechanism. The pressure sensing mechanism sets a target pressure and detects the gas pressure in a suction chamber of the compressor, or the suction pressure. The pressure sensing mechanism is displaced by the difference between the target pressure and the suction pressure, which automatically changes the opening amount of the control valve. The target pressure of the internally controlled control valve cannot be changed externally. It is sometimes desirable to change the displacement of a compressor in accordance with the running state of the engine regardless of the suction pressure, which represents the cooling load. However, if the compressor has an internally controlled control valve, the compressor displacement cannot be controlled based on the engine running state since the target pressure cannot be changed externally.

An externally controlled control valve includes a pressure sensing mechanism and an electromagnetic actuator coupled to the pressure sensing mechanism. The displacement of the compressor is determined by a controller based on the running state of the engine and the running state of the vehicle. The controller then electrically actuates the electromagnetic actuator, accordingly. In this manner, the target pressure of the externally controlled control valve is determined in accordance with external factors. Thus, the displacement of the compressor is optimized for the running state of the engine. Specifically, when the vehicle requires a relatively great amount of power, for example, when the vehicle is rapidly accelerated, the load of the compressor on the engine can be reduced.

The pressure sensing mechanism includes a pressure sensing member, which is a bellows, and a spring located in the bellows. The bellows is displaced along its axis, or expanded and contracted, in accordance with the suction pressure. The electromagnetic actuator includes a solenoid and associated parts. The solenoid is axially aligned with the bellows.

The pressure sensing mechanism must be axially aligned with the electromagnetic actuator such that the bellows is axially aligned with the solenoid. This complicates the structure of the control valve and increases the number of parts. Thus, the cost and the number of assembly steps are increased. Also, the size of the compressor is enlarged. The controller has an amplifier to actuate the solenoid. Since the pressure sensing mechanism is actuated by the electromagnetic actuator, a relatively great electrical load is applied to the amplifier.

SUMMARY OF THE INVENTION

Accordingly, it is an objective of the present invention to provide a variable displacement compressor that varies the compressor displacement externally by changing the target pressure of an internally controlled control valve. The variable displacement compressor of the present invention is obtained by applying a simple change to a compressor having a prior art internally controlled control valve.

To achieve the foregoing and other objectives and in accordance with the purpose of the present invention, a variable displacement compressor that has a suction zone, a discharge zone, a crank chamber, a displacement control valve and a displacement control passage is provided. The displacement control passage is controlled by the displacement control valve to vary the pressure in the crank chamber. The compressor compresses gas drawn from the suction pressure zone and discharges the compressed gas to the discharge zone. The displacement of the compressor varies according to the pressure of the crank chamber. The displacement control valve includes a valve chamber, a valve body, a pressure sensing chamber, a pressure sensing mechanism and an electromagnetic valve. The valve chamber forms part of the displacement control passage. The valve body is located in the valve chamber to regulate an opening in the displacement control passage. The pressure sensing chamber is connected to the suction zone and the discharge zone. Gas flows into the pressure sensitive chamber from the discharge zone through an inlet passage and flows out of the pressure sensing chamber to the suction zone through an outlet passage. The pressure sensing mechanism is located in the pressure sensing chamber. The pressure sensing mechanism acts on the valve body to adjust the position of the valve body according to the pressure in the pressure sensing chamber. The electromagnetic valve regulates one of the inlet passage and the outlet passage to change the pressure of the pressure sensing chamber according to a determination based on external conditions.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Variable displacement swash plate type compressors according to the present invention will now be described. The compressor of the present invention is used in an air-conditioning system of a vehicle.

A variable displacement swash plate type compressor according to a first embodiment will now be described with reference to FIGS. 1 to 3.

Figure 1:
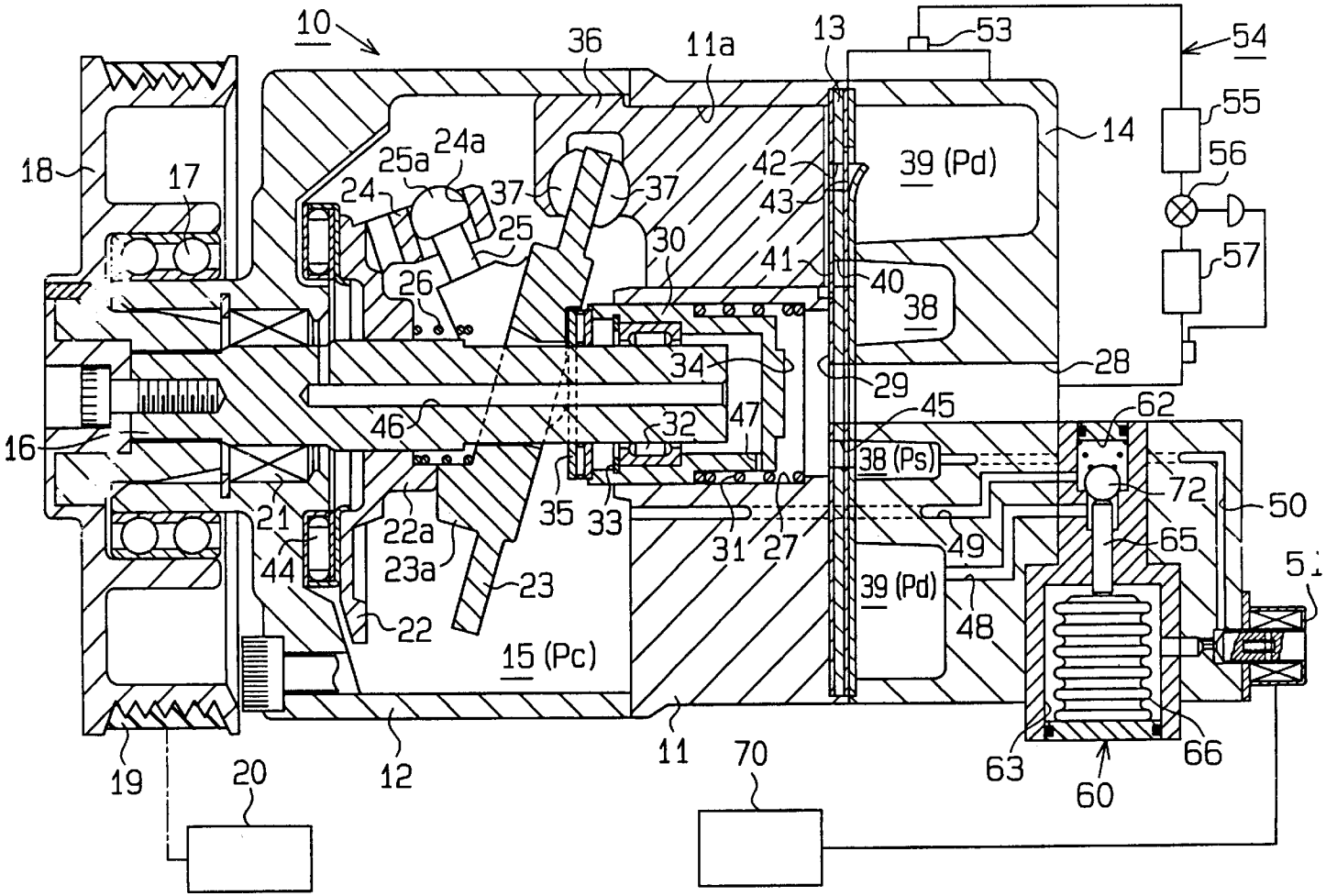
FIG. 1 is a cross-sectional view illustrating a swash plate type variable displacement compressor according to a first embodiment.

As shown in FIG. 1, a swash plate type variable displacement compressor 10 includes a cylinder block 11, front housing 12 and a rear housing 14. The front housing 12 is secured to the front end face of the cylinder block 11. The rear housing 14 is secured to the rear end face of the cylinder block 11, and a valve plate 13 is located between the rear housing 14 and the rear end face. The cylinder block 11 and the front housing 12 define a crank chamber 15. The cylinder block 11 and the front housing 12 rotatably support a drive shaft 16. The front housing 12 has a cylindrical wall extending forward. The front end of the drive shaft 16 is located in the cylindrical wall of the front housing 12.

A pulley 18 is supported by the cylindrical wall with an angular bearing 17. The pulley 18 is coupled to the front end of the drive shaft 16. The pulley 18 is coupled to an engine 20 by a belt 19. In this manner, the compressor 10 is coupled to the engine 20 without a clutch such as an electromagnetic clutch. The compressor 10 is therefore always driven when the engine 20 is running.

A lip seal 21 is located between the drive shaft 16 and the inner wall of the front housing 12 to seal the crank chamber 15. A rotor 22 is fixed to the drive shaft 16 in the crank chamber 15.

A cam plate, or swash plate 23, is located in the crank chamber 15. The swash plate 23 has a hole formed in the center. The drive shaft 16 extends through the swash plate 23. The swash plate 23 is coupled to the rotor 22 by a hinge mechanism (24, 25). The hinge mechanism (24, 25) and the contact between the swash plate 23 and the drive shaft 16 at the center hole of the swash plate 23 permits the swash plate 23 to slide along the drive shaft 16 and to tilt with respect to the axis of the drive shaft 16. The swash plate 23 has a counterweight 23a located at the opposite side of the hinge mechanism (24, 25) with respect to the hinge mechanism (24, 25).

The hinge mechanism includes a pair of support arms 24 (only one is shown) and a pair of guide pins 25 (only one is shown). The arms 24 protrude from the rear surface of the rotor 22. The guide pins 25 protrude from the front surface of the swash plate 23. Each arm 24 has a guide hole 24*a* formed at its distal end. Each guide pin 25 has a guide ball 25*a* at its distal end. Each guide ball 25*a* is fitted in the corresponding guide hole 24*a*. The cooperation of the arms 24 and the guide pins 25 permits the swash plate 23 to rotate integrally with the shaft 16. The cooperation also guides the inclination of the swash plate 23 along the shaft 16.

The inclination of the swash plate 23 is changed by sliding contact between the guide holes 24*a* and the guide balls 25*a* and by sliding contact between the drive shaft 16 and the swash plate 23. The inclination of the swash plate 23 decreases as the swash plate 23 moves toward the cylinder block 11. A first spring (compression spring) 26 is fitted about the drive shaft 16 between the rotor 22 and the swash plate 23. The first spring 26 urges the swash plate 23 toward the cylinder block 11, or in a direction to decrease the inclination of the swash plate 23. As shown in FIG. 1, the rotor 22 has a projection 22*a* on its rear end face. Abutment of the swash plate 23 against the projection 22*a* limits the maximum inclination of the swash plate 23.

The cylinder block 11 has a centrally located shutter chamber 27. A suction passage 28 is formed in the center of the rear housing 14. The suction passage 28 communicates with the shutter chamber 27. A positioning surface 29 is formed about the inner opening of the suction passage 28.

A cup-shaped shutter 30 is accommodated in the shutter chamber 27. The shutter 30 slides in the direction of the axis of the drive shaft 16. A second coil spring (compression spring) 31 extends between the shutter 30 and a step formed on the wall of the shutter chamber 27. The second spring 31 urges the shutter 30 toward the swash plate 23. The rear end of the drive shaft 16 is inserted in the shutter 30. A radial bearing 32 is located between the drive shaft 16 and the inner wall of the shutter 30. A snap ring 33 prevents the radial bearing 32 from disengaging from the shutter 30. The snap ring 33 also permits the radial bearing 32 to move along the axis of the drive shaft 16 with the shutter 30. Therefore, the rear end of the drive shaft is rotatably supported by the shutter chamber 27 with the shutter 30 and the radial bearing 32 in between. The rear end of the shutter 30 functions as a shutter surface 34, which abuts against the positioning surface 29. Abutment of the shutter surface 34 against the positioning surface 29 disconnects the suction passage 28 from the shutter chamber 27.

A thrust bearing 35 is supported on the drive shaft 16 and is located between the swash plate 23 and the shutter 30. The thrust bearing 35 slides axially on the drive shaft 16. The force of the springs 26, 31 constantly retains the thrust bearing 35 between the swash plate 23 and the shutter 30. Thus, as the inclination of the swash plate 23 decreases, the shutter 30 is moved toward the positioning surface 29 against the force of the second spring 31. The shutter surface 34 of the shutter 30 is eventually contacts the positioning surface 29. The abutment of the shutter surface 34 against the positioning surface 29 prevents the swash plate 23 from moving beyond a predetermined minimum inclination. The minimum inclination of the swash plate 23 is slightly more than zero degrees.

Cylinder bores 11*a* (only one is shown) are formed in the cylinder block 11. The cylinder bores 11*a* located about the drive shaft 16. A single-headed piston 36 is accommodated in each cylinder bore 11*a*. The front end (opposite end from compressing surface) of each piston 22 is coupled to the periphery of the swash plate 23 by way of a pair of shoes 37. In other words, the shoes 37 couple the pistons 36 to the swash plate 23. The pistons 36 are reciprocated by rotation of the swash plate 23.

The stroke of each piston 36 changes in accordance with the inclination of the swash plate 23, which varies the compressor displacement. However, the top dead center position of each piston 36 is maintained at substantially the same point in the cylinder 11*a* by the hinge mechanism (24, 25) despite changes of the swash plate inclination. When each piston 36 is located at the top dead center position, the top clearance of each piston 36 is substantially zero.

An annular suction chamber 38 is defined centrally in the rear housing 14 about the suction passage 28. An annular discharge chamber 39 is defined about the suction chamber 38 in the rear housing 14. The suction chamber 38 is connected with the shutter chamber 27 by a communication hole 45. When the shutter surface 34 contacts the positioning surface 29, the suction chamber 38 is disconnected from the suction passage 28. The suction passage 28, the shutter chamber 27, the communication hole 45 and the suction chamber 38 define the suction pressure zone. The discharge chamber 39 defines the discharge pressure zone.

Suction ports 40 and discharge ports 42 are formed in the valve plate 13. Each port 40, 42 corresponds to one of the cylinder bores 11*a*. Suction valve flaps 41 are formed on the valve plate 13. Each suction valve flap 41 corresponds to one of the suction ports 40. Discharge valve flaps 43 are formed on the valve plate 13. Each discharge valve flap 43 corresponds to one of the discharge ports 42. Refrigerant gas is drawn into the suction chamber 38 through an external refrigerant circuit 54, which will be described later, the suction passage 28 and the communication hole 45. As each piston 36 moves from the top dead center position to the bottom dead center position, refrigerant gas is drawn into the corresponding suction port 40 from the suction chamber 38 thereby opening the suction valve flap 41 to enter the associated cylinder bore 11*a*. As each piston 36 moves from the bottom dead center position to the top dead center position in the associated cylinder bore 11*a*, the gas in the cylinder bores 11*a* is compressed. The gas is then discharged to the discharge chamber 39 through the associated discharge port 42 while causing the associated valve flap 43 to flex to an open position. The gas compression creates a compression reaction force. The compression reaction force is transmitted to and received by the inner wall of the front housing 12 through a thrust bearing 44 located between the rotor 22 and the front housing 12.

An axial passage 46 is formed along the axis of the drive shaft 16. The inlet of the axial passage 46 is located in the vicinity of the lip seal 21. The outlet of the axial passage 46 is located in the rear end of the drive shaft 16 and communicates with the interior of the shutter 30. A pressure release hole 47 is formed in the shutter wall near the rear end of the shutter 30 for connecting the interior of the shutter 30 with the shutter chamber 27. The hole 47 functions as a throttle and releases the pressure in the shutter 30. The shutter chamber 27, the pressure release hole 47, the axial passage 46 define a bleeding passage for gradually releasing gas from the crank chamber 15 to the suction chamber 38.

As shown in FIG. 1, a displacement control valve 60 is located in the rear housing 14. The displacement control valve 60 regulates a displacement control passage that supplies gas to the crank chamber 15. The control valve 60 controls the pressure Pc in the crank chamber 15. The control valve 60 is connected to the discharge chamber 39 by a first part 48 of the displacement control passage and to the crank chamber 15 by a second part 49 of the displacement control passage. Refrigerant gas flows into the control valve 60 from the discharge chamber 39. Also, the control valve 60 is connected to the suction chamber 38 by an outlet passage 50. An electromagnetic flow control valve, which is an electromagnetic valve 51, is located in the outlet passage 50. Refrigerant gas is supplied to the control valve 60 from the discharge chamber 39. The electromagnetic valve 51 is fixed to the rear end of the rear housing 14. The electromagnetic valve 51 controls the flow of refrigerant gas released from the control valve 60.

A discharge port 53 is formed in the rear housing 14 to discharge compressed refrigerant gas. The discharge port 53 is connected with the suction passage 28 by the external refrigerant circuit 54. The external refrigerant circuit 54 includes a condenser 55, an expansion valve 56 and an evaporator 57. The external refrigerant circuit 54 and the compressor 10 define a cooling circuit of the vehicle air conditioning system.

The displacement control valve 60 will now be described.

Figure 2:
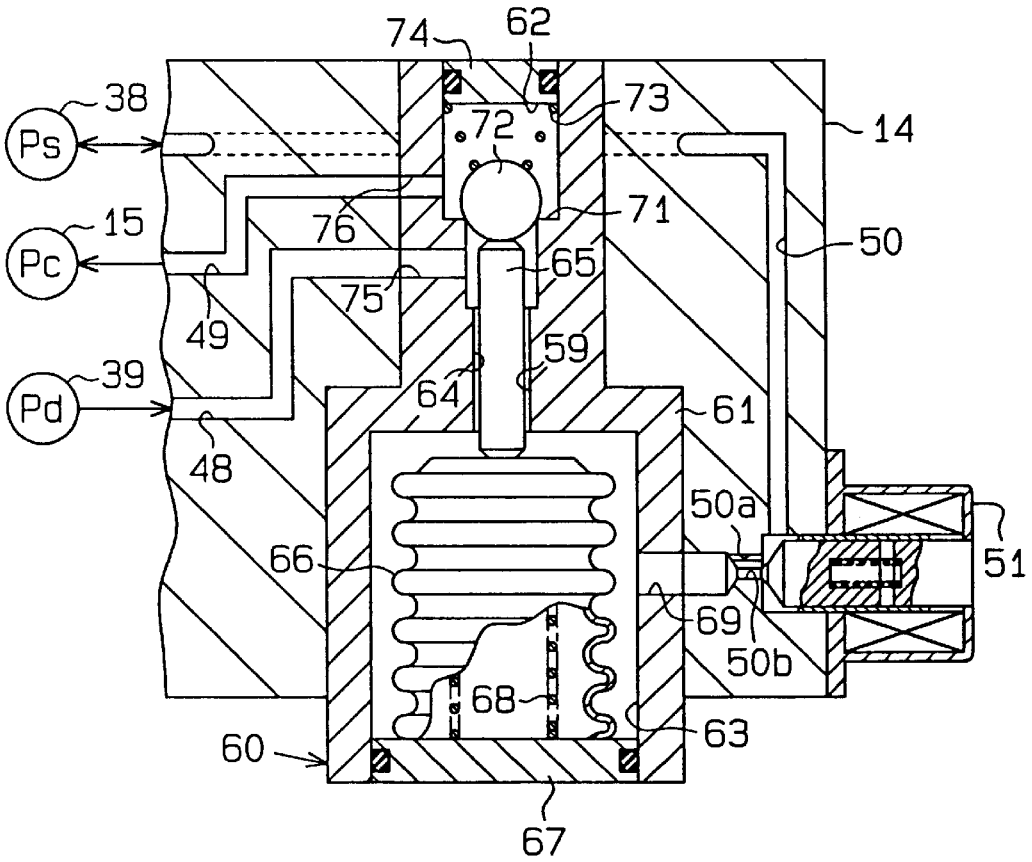
FIG. 2 is an enlarged partial cross-sectional view illustrating a control valve of the compressor of FIG. 1.

As shown in FIG. 2, the displacement control valve 60 includes a housing 61. A valve chamber 62 is defined in the upper portion of the housing 61. A pressure sensing chamber 63 is defined in the lower portion of the housing 61. A rod guide 64 extends between the valve chamber 62 and the pressure sensing chamber 63. The rod guide 64 supports a rod 65, which can slide axially along the rod guide 64. A clearance is defined between the rod guide 64 and the rod 65 to connect the valve chamber 62 with the pressure sensing chamber 63. The clearance forms an inlet passage 59.

The bottom of the pressure sensing chamber 63 is formed by a first seal plate 67. A pressure sensing member, which is a bellows 66, is located in the pressure sensing chamber 63. The proximal end of the bellows 66 is secured to the first seal plate 67. The pressure in the bellows 66 is vacuum pressure or an extremely low pressure. A bellows spring (compression coil spring) 68 is located in the bellows 66. The bellows spring 68 expands the bellows 66, thereby causing the upper end of the bellows 66 to contact the lower end of the rod 65. When the pressure Pk in the pressure sensing chamber 63 is equal to or higher than a predetermined value, the bellows 66 contracts. The predetermined value of the pressure Pk is determined by the force of the bellows spring 68. When the pressure Pk is lower than the predetermined value, the bellows 66 urges the rod 65 toward the valve chamber 62. The bellows 66 and the bellows spring 68 define a pressure sensing mechanism.

A hole 69 is formed in the wall of the valve housing 61. The hole 69 connects the pressure sensing chamber 63 with the outlet passage 50. The outlet passage 50 includes a bypass passage 50*a* and a valve passage 50*b*. The bypass passage 50*a* bypasses the electromagnetic valve 51 and serves as a fixed restrictor.

An annular valve seat 71 is formed in the center of the lower wall of the valve chamber 62. The valve seat 71 divides the valve chamber 62 into an upper portion and a lower portion.

The upper portion of the rod 65 protrudes from the rod guide 64 into the lower portion of the valve chamber 62. A spherical valve body 72 and a valve spring 73 are located in the upper portion of the valve chamber 62. The diameter of the valve body 72 is large enough to completely close the hole surrounded the valve seat 71. The ceiling of the valve chamber 62 is formed by a second seal plate 74. The upper end of the valve spring 73 is engaged with the second seal plate 74. The lower end of the valve spring 73 is engaged with the valve body 72. The valve spring 73 urges the valve body 72 downward, or in a direction to close the hole surrounded by the valve seat 71. The rod 65 permits the valve body 72 to move integrally with the bellows 66.

A first hole 75 and a second hole 76 are formed radially in the valve housing 61. The first hole 75 opens to the lower portion of the valve chamber 62 and is connected to the discharge chamber 39 by the first part 48 of the displacement control passage. The second hole 76 opens to the upper portion of the valve chamber 62 and is connected to the crank chamber 15. Accordingly, the lower portion of the valve chamber 62 is connected to the discharge chamber 39. The upper portion of the valve chamber 62 is connected to the crank chamber 15. In this embodiment the displacement control passage 48, 49, 62 is a supply passage that delivers gas to the crank chamber 15.

When the pressure Pk in the pressure sensing chamber 63 is relatively high, the rod 65 is not moved toward the valve chamber 62. In this state, the force of the valve spring 73 causes the valve body 72 to contact the valve seat 71 thereby disconnecting the first hole 75 from the second hole 76. When the pressure Pk in the pressure sensing chamber 63 is relatively low, the bellows 66 moves the rod 65 toward the valve chamber 62. In this state, the valve body 72 is moved against the force of the valve spring 73, which separates the valve body 72 from the valve seat 71. Accordingly, the first hole 75 is connected with the second hole 76 via the valve chamber 62.

As described above, the valve chamber 62 is connected with the discharge chamber 39 and the crank chamber 15. The valve body 72 therefore receives a force resulting from the difference between the discharge pressure Pd and the crank chamber pressure Pc. The direction of the resultant force matches the direction of the force applied to the bellows 66 by the bellows spring 68.

The operation of the displacement control valve 60 will now be described.

Assume that the control valve 60 has no inlet passage. That is, assume that the pressurized gas from the discharge chamber 39 is not supplied to the pressure sensing chamber 63 through the valve chamber 62 and the inlet passage 59. In this case, the pressure Pk in the pressure sensing chamber 63 changes in accordance with the suction pressure Ps of the suction chamber 38. That is, the control valve 60 controls the opening amount of the valve chamber 62 based on the suction pressure Ps. The suction pressure Ps at which the control valve 60 is closed is referred to as a target suction pressure Pset. Without the inlet passage 59, the target suction pressure Pset is determined by the force of the bellows spring 68.

When the suction pressure Ps increases and becomes equal to or higher than the target suction pressure Pset, the pressure Pk in the pressure sensing chamber 63 exceeds a predetermined value, which contracts the bellows 66 against the force of the bellows spring 68. Then, the valve body 72 closes the valve chamber 62 thereby stopping the flow of highly pressurized gas from the discharge chamber 39 to the crank chamber 15 through the valve chamber 62. As a result, gas flow through the bleeding passage 46, 47 lowers the crank chamber pressure Pc, or the back pressure of the pistons 36, which increases the inclination of the swash plate 23. Accordingly, the stroke of each piston 36 is increased, which increases the compressor displacement, which lowers the suction pressure Ps and the pressure Pk in the pressure sensing chamber 63.

When the suction pressure Ps is lower than the target suction pressure Pset, the pressure Pk in the pressure sensing chamber 63 falls below the predetermined value, which causes the bellows spring 68 to expand the bellows 66. Accordingly, the valve body 72 opens the valve chamber 62 thereby drawing highly pressurized gas in the discharge chamber 39 to the crank chamber 15 through the valve chamber 62. As a result, the crank chamber pressure Pc which decreases the inclination of the swash plate. The stroke of each piston 36 is decreased, accordingly. The decreased piston stroke decreases the compressor displacement. The suction pressure Ps and the pressure Pk in the pressure sensing chamber 63 are increased, accordingly.

The above description of the control valve 60 without the inlet passage 59 describes the basic operation of a prior art internally controlled valve. The displacement control valve 60 of FIG. 2 operates based on the same basic principle. The suction pressure Ps that is used as a threshold value for opening and closing the valve chamber 62 is defined as the target suction pressure Pset. In the prior art internally controlled valve, the target suction pressure Pset is determined by the force of the bellows spring 68, which forms the pressure sensing mechanism. In other words, the target suction pressure Pset cannot be externally controlled in the prior art valve. However, in the displacement control valve 60 according to FIG. 2, the inlet passage 59 permits the highly pressurized gas in the discharge chamber 39 to enter the pressure sensing chamber 63, which changes the target suction pressure Pset.

The principle for changing the target suction pressure Pset will now be described.

Highly pressurized gas in the discharge chamber 39 flows into the lower portion of the valve chamber 62. The gas constantly flows into the pressure sensing chamber 63 through the inlet passage 59 between the rod guide 64 and the rod 65. Therefore, when the suction pressure Ps in the suction chamber 38 is lower than the target suction pressure Pset that is determined by the bellows spring 68 (hereinafter referred to as Pset0), the pressure Pk in the pressure sensing chamber 63 quickly reaches the target suction pressure Pset0. The target suction pressure Pset is lowered below the target suction pressure Pset0. Qualitatively, supplying highly pressurized gas from the discharge chamber 39 to the pressure sensing chamber 63 through the inlet passage 59 lowers the actual target suction pressure Pset below the target suction pressure Pset0. Refrigerant gas in the discharge chamber 39 is supplied to the pressure sensing chamber 63 through the inlet passage 59 such that the pressure Pk in the pressure sensing chamber 63 is proportional to the suction pressure Ps in the suction chamber 38.

As described, highly pressurized gas is supplied to the pressure sensing chamber 63 from the discharge chamber 39 through the inlet passage 59. When the electromagnetic valve 51 is opened, the highly pressurized gas in the pressure sensing chamber 63 is released to the suction chamber 38 through the valve passage 50*b*. The pressure Pk in the pressure sensing chamber 63 is therefore slightly higher than the suction pressure Ps. The direction of the force applied to the valve body 72 created by the difference between the discharge pressure Pd and the crank chamber pressure Pc matches the direction of the force applied to the valve body 72 by the bellows spring 68 via the rod 65. In other words, the force of the pressure difference adds to the force of the bellows spring 68. Therefore, the target suction pressure Pset1 when the electromagnetic valve 51 is opened is higher than the target suction pressure Pset0 as shown in FIG. 3. Also, as shown in FIG. 3, the target suction pressure Pset1 gradually increases as the discharge pressure Pd increases.

Highly pressurized gas in the discharge chamber 39 is supplied to the pressure sensing chamber 63 through the inlet passage 59. When the electromagnetic valve 51 is closed, the amount of gas released from the pressure sensing chamber 63 is limited by the bypass passage 50*a*, which serves as a fixed restrictor. The pressure Pk in the pressure sensing chamber 63 is significantly higher than the suction pressure Ps. That is, although the suction pressure Ps is lower than the target suction pressure Pset0, the pressure Pk in the pressure sensing chamber 63 easily reaches the target suction pressure Pset0 when the electromagnetic valve 51 is closed. The force created by the difference between the discharge pressure Pd and the crank chamber pressure Pc also adds to the force of the bellows spring 68. Therefore, the target suction pressure Pset2 when the electromagnetic valve 51 is closed is lower than the target suction pressure Pset0 as shown in FIG. 3. The target suction pressure Pset 2 decreases as the discharge pressure Pd increases. A uniformly broken line in FIG. 3 represents the lower limit value of the suction pressure Ps, at which frost is formed in the evaporator 57.

Figure 3:
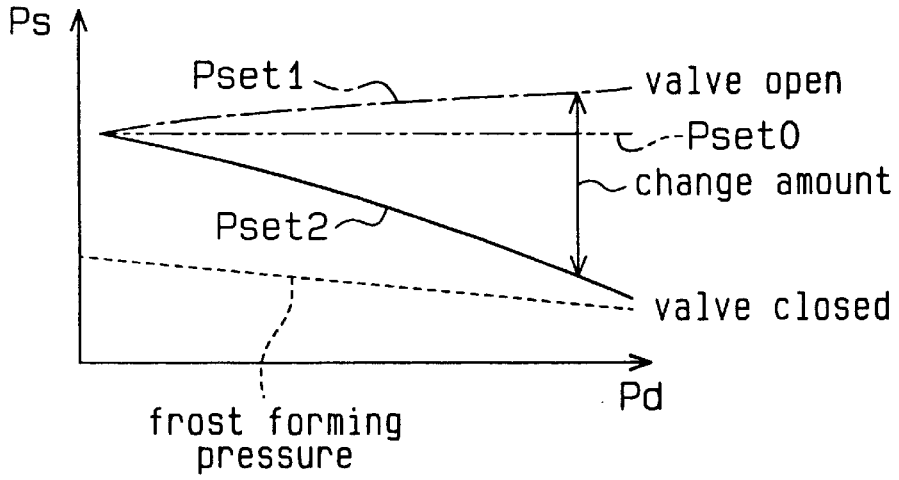
FIG. 3 is a graph showing the relationship between target pressure and discharge pressure.

In the embodiment of FIGS. 1 to 3, the force of the bellows spring 68 is determined such that the target suction pressure Pset1 is significantly higher than the frost forming pressure. The amount of gas supplied to the pressure sensing chamber 63 from the discharge chamber 39 through the inlet passage 59 is determined such that the target suction pressure Pset2 is relatively close to the frost forming pressure.

The electromagnetic valve 51 closes the valve passage 50*b* when de-excited. In this state, the pressure sensing chamber 63 is connected to the suction chamber 38 only via the bypass passage 50*a*. When excited, the electromagnetic valve 51 opens the valve passage 50*b*. In this state, the pressure sensing chamber 63 is connected to the suction chamber 38 via the bypass and valve passages 50*a*, 50*b*. The electromagnetic valve 51 is controlled by the controller 70.

The controller 70 is part of the control unit of the vehicle air-conditioning system or an electronic control unit (ECU) of the engine 20, which stores interrupt routine programs for controlling the electromagnetic valve 51. The controller 70 controls the electromagnetic valve 51 based on information from sensors and a switch (neither is shown). Normally, the controller 70 de-excites the electromagnetic valve 51 thereby closing the valve passage 50*b*.

The operation of the variable displacement compressor 10 will now be described.

The control valve 60 basically operates in the following manner regardless of which of the target pressures Pset1 or Pset2 is used as the target suction pressure Pset.

Refrigerant gas is drawn into the suction chamber 38 from the external refrigerant circuit 54. When the temperature of the passenger compartment is relatively high, the suction pressure Ps in the suction chamber 38 increases. If the increased suction pressure Ps in the pressure sensing chamber 63 exceeds the target suction pressure Pset, the bellows 66 contracts. Accordingly, the valve body 72 is moved toward the valve seat 71 by the valve spring 73, which closes the valve chamber 62. In other words, highly pressurized gas in the discharge chamber 39 is not supplied to the crank chamber 15 via the valve chamber 62. On the other hand, refrigerant gas in the crank chamber 15 is released to the suction chamber 38 through the bleeding passage (46, 47, 27), which lowers the crank chamber pressure Pc, or the back pressure of the pistons 36. The inclination of the swash plate 23 is increased, accordingly. As a result, the stroke of each piston 36 is increased and the displacement of the compressor 10 is increased.

When the passenger compartment temperature is relatively low, the suction pressure Ps falls below the target suction pressure Pset. In this case, the bellows 66 expands and lifts the valve body 72 through the rod 65, which opens the valve chamber 62. Highly pressurized gas in the discharge chamber 39 is consequently supplied to the crank chamber 15 through the valve chamber 62. On the other hand, the flow of refrigerant gas from the crank chamber 15 to the suction chamber 38 is limited by the pressure release hole 47. The crank chamber pressure Pc, or the back pressure of the pisotns 36, is thus increased. The increased pressure Pc decreases the inclination of the swash plate 23. As result, the stroke of each piston 36 is decreased and the displacement of the compressor 10 is decreased.

The suction pressure Ps represents the cooling load. As described above, the control valve 60 controls the crank chamber pressure Pc based on the suction pressure Ps, which is an internal characteristic of the compressor 10. In other words, the control valve 60 automatically controls the crank chamber pressure Pc.

When the swash plate 23 is inclined at the minimum angle, which is slightly greater than zero degrees, the shutter surface 34 of the shutter 30 abuts against the positioning surface 29. Accordingly, the flow of refrigerant gas from the external refrigerant circuit 54 to the suction chamber 38 is stopped. However, in this state, refrigerant gas continues to be discharged from the cylinder bores 11*a* to the discharge chamber 39. The refrigerant gas sent to the discharge chamber 39 flows to the suction chamber 38 through the first part 48 of the displacement control passage, the valve chamber 62, the second part 49 of the displacement control passage, the crank chamber 15 and the bleeding passage 46, 47. The gas in the suction chamber 38 is then drawn into the cylinder bores 11*a* compressed and discharged to the discharge chamber 39. Even if the inclination of the swash plate 23 is minimum and the shutter 30 completely shuts the suction passage 28, refrigerant gas follows an internal circulation path within the compressor. In this state, the pressure differences among the discharge chamber 39, the crank chamber 15, and the suction chamber 38 are maintained. The pressure differences enable the refrigerant gas in the compressor to circulate along the internal circulation path. Meanwhile, lubricant oil is circulated in the compressor together with refrigerant gas. The compressor is thus reliably lubricated.

The controller 70 electrically receives information regarding to the state of the vehicle, such as information regarding the speed or acceleration of the vehicle and the mode of the automatic transmission. The controller 70 optimally controls the electromagnetic valve 51 based on the received information.

Specifically, when the vehicle speed is constant or when the automatic transmission is in the normal drive mode, the controller 70 does not excite the electromagnetic valve 51, which maintains the electromagnetic valve 51 in its closed position. Accordingly, the target suction pressure Pset in the pressure sensing chamber 63 is switched to the target suction pressure Pset2, which is relatively low. In this state, even if the cooling load is small and the suction pressure Ps is relatively low, the compressor 10 is ready to operate with a large displacement. When the vehicle is accelerated or when the automatic transmission is in an economy mode, the controller 70 excites the electromagnetic valve 51 thereby opening the electromagnetic valve 51. Accordingly, the target suction pressure Pset is switched to the target suction pressure Pset1, which is relatively high. In this state, even if the cooling load is great and the suction pressure Ps is relatively high, the compressor 10 is not easily switched to the large displacement mode.

The compressor 10 according to the embodiment of FIGS. 1 to 3 has the following advantages.

(1) When the load acting on the engine 20 is relatively small, for example, when the vehicle is moving at a normal speed, the controller 70 closes the electromagnetic valve 51 thereby switching the target pressure Pset to the lower value Pset2. In other words, the controller 70 allows the compressor 10 to operate at the maximum displacement. On the other hand, when most of the power of the engine 20 needs to be allotted to the vehicle power train, for example, when the vehicle is accelerated, the controller 70 opens the electromagnetic valve 51 thereby switching the target suction pressure Pset to the higher value Pset1. In other words, the controller 70 decreases the displacement of the compressor 10 thereby reducing the load of the compressor 10 on the engine 20. In this manner, the target suction pressure Pset is optimally selected in accordance with the running state of the engine 20. The displacement of the compressor 10 is therefore externally controlled.

(2) The control valve 60 of the first embodiment is basically the same as a prior art control valve except for the inlet passage 59. The inlet passage 59 permits highly pressurized gas from the discharge chamber to enter the pressure sensing chamber 63 of the control valve 60. In other words, a simple modification to a prior art control valve produces the control valve 60, which can select the target suction pressure Pset among two values. Therefore, unlike prior art externally controlled valves, the control valve 60 needs no large electromagnetic actuator for varying the target suction pressure Pset, which reduces the cost of the control valve 60 and facilitates the installation of the valve 60 to a compressor.

(3) The electromagnetic valve 51 is required for switch the target suction pressure Pset. Specifically, the electromagnetic valve 51 changes the amount of gas released from the pressure sensing chamber 63. However, the electromagnetic valve 51 regulates the outlet passage 50. Discharge gas is introduced into the pressure sensing chamber 63 to generate the pressure Pk. The outlet passage 50 is designed to release gas from the pressure sensing chamber 63 and has a relatively small cross-sectional area. Therefore, compared to the electromagnetic actuator in prior art externally controlled valves, the electromagnetic valve 51 is small and consumes less electricity.

(4) The discharge pressure Pd is applied to the valve chamber 62 of the control valve 60 by the first part 48 of the displacement control passage formed in the compressor 10. The discharge pressure Pd in the valve chamber 62 is applied to the pressure sensing chamber 63 through the inlet passage 59 defined between the valve chamber 62 and the pressure sensing chamber 63. Therefore, there is no need to form a passage in the compressor 10 for applying the discharge pressure Pd from the discharge chamber 39 to the pressure sensing chamber 63. Thus, only three passages, namely, the outlet passage 50 and the first and second parts 48, 49 of the displacement control passage need to be connected to the control valve 60. The outlet passage 50 applies the suction pressure Ps from the suction chamber 38 to the control valve 60. The first part 48 of the displacement control passage applies the discharge pressure Pd from the discharge chamber 39 to the control valve 60. The second part 49 of the displacement control passage supplies refrigerant gas to the crank chamber 15. In short, only three passages need to be formed in the compressor 10, which reduces the number of machining steps required when manufacturing the compressor 10.

(5) The bellows 66 is located in the pressure sensing chamber 63. The valve body 72 is located in the valve chamber 62. The bellows 66 moves the valve body 72 with the rod 65. The clearance defined between the rod 65 and the rod guide 64, or the inlet passage 59, applies the discharge pressure Pd from the valve chamber 62 to the pressure sensing chamber 63. Compared to a case where a separate passage is formed in the valve housing 61, the pressure sensing chamber 63 is connected to the valve chamber 62 by a relatively simple construction.

(6) The gradient of the values in the graph of FIG. 3 can be altered by changing the ratio of the cross-sectional area of the inlet passage 59 to that of the bypass passage 50*a*. A larger cross-sectional area of the bypass passage 50*a*, that is, a greater amount of gas leakage from the pressure sensing chamber 63, represents a greater value of the target suction pressure Pset for a given value of the discharge pressure Pd. In other words, as the amount of gas leakage increases, the gradient of the line representing the target suction pressure Pset1 becomes more steep and the gradient of the line representing the target suction pressure Pset2 becomes less steep.

(7) Unlike the illustrated control valve 60, the prior art control valve cannot switch the target suction pressure Pset. If the refrigerant circuit 54 uses a variable displacement compressor having such a prior art control valve, the target suction pressure Pset of the internal controlled valve must be initially determined in accordance with the type of vehicle. Specifically, the target suction pressure Pset must be determined in consideration of the pressure loss between the outlet of the evaporator 57 and the inlet of the compressor 10 such that the pressure at the outlet of the evaporator 57 is constant. The pressure loss varies in accordance with the length of the pipe connecting the evaporator 57 with the compressor 10. However, in the embodiment of FIGS. 1 to 3, at least the second target suction pressure Pset 2 can be freely adjusted by changing the cross-sectional area of the inlet passage 59. Specifically, changing the cross-sectional area of the inlet passage 59 varies the amount of highly pressurized gas supplied to the pressure sensing chamber 63 from the discharge chamber 39. Thus, compared to the prior art compressor, the compressor of FIGS. 1 to 3 simplifies the design of the air-conditioning system.

A swash plate type variable displacement compressor according to a second embodiment will now be described with reference to FIGS. 4 and 5. The compressor of the second embodiment is the same as the first embodiment except for part of the control valve 60. Therefore, like or the same reference numerals are given to those components that are like or the same as the corresponding components of FIGS. 1 to 3.

Figure 4:
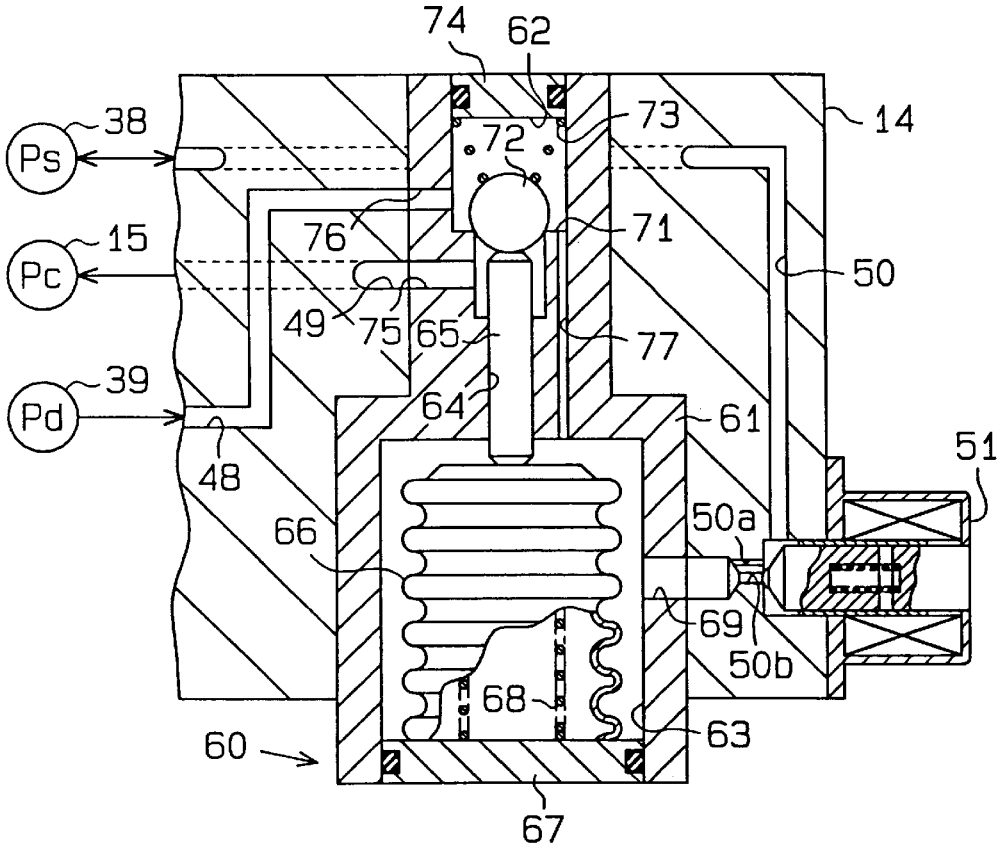
FIG. 4 is an enlarged partial cross-sectional view illustrating a control valve according to a second embodiment.

As shown in FIG. 4, the lower portion of the valve chamber 62 is connected to the crank chamber 15 through the first hole 75 and the down stream part 49 of the supply passage. The upper portion is connected to the discharge chamber 39 though the second hole 76 and the first part 48 of the displacement control passage. When the pressure Pk in the pressure sensing chamber 63 is relatively high, the bellows 66 does not move the rod 65 toward the valve chamber 62. In this state, the valve body 72 is pressed against the valve seat 71 by the valve spring 73, which disconnects the first hole 75 from the second hole 76. When the pressure Pk is relatively low, the bellows 66 moves the rod 65 toward the valve chamber 62. In this state, the valve body 72 is moved against the force of the valve spring 73, which separates valve body 72 from the valve seat 71. Then, the first hole 75 is connected to the second hole 76 via the valve chamber 62.

That is, unlike the control valve 60 of FIGS. 1 to 3, the direction in which the valve body 72 is urged by the difference between the discharge chamber pressure Pd and the suction chamber pressure Pc is opposite from the direction of the force of the bellows spring 68.

The valve housing 61 has an inlet passage 77. The inlet passage 77 connects the upper portion of the valve chamber 62 with the pressure sensing chamber 63.

The target suction pressure Pset is determined in the following manner in the control valve 60 of FIGS. 4 and 5.

When the electromagnetic valve 51 is open, highly pressurized gas is drawn in the pressure sensing chamber 63 from the discharge chamber 39 through the valve chamber 62 and The inlet passage 77. At the same time, gas in the pressure sensing chamber 63 is released to the suction chamber 38 through the outlet passage 50. As a result, the pressure Pk in the pressure sensing chamber 63 is slightly higher than the suction pressure Ps. The force created by the difference between the discharge pressure Pd and the crank chamber pressure Pc urges the valve body 72 toward the valve seat 71. In other words, the force of the pressure difference, which is an increasing function of the discharge pressure Pd, acts against the force of the bellows spring 68. Therefore, when the electromagnetic valve 51 is open, the target suction pressure Pset1 gradually decreases as the discharge pressure Pd increases as shown in FIG. 5.

When the electromagnetic valve 51 is closed, highly pressurized gas in the pressure sensing chamber 63 is released to the suction chamber 38 through the bypass passage 50*a*. As a result, the pressure Pk in the pressure sensing chamber 63 is higher than the suction pressure Ps. As in the case where the electromagnetic valve 51 is open, the force created by the difference between the discharge pressure Pd and the crank chamber Pc acts against the force of the bellows spring 68. Therefore, as illustrated in FIG. 5, the target suction pressure Pset2, which applies when the electromagnetic valve 51 is closed, decreases as the discharge pressure Pd increases.

The target suction pressure Pset is set to the value Pset 2 when the vehicle speed is constant or when the automatic transmission is in the normal drive mode. Therefore, even if the cooling load is small and the suction pressure Ps is relatively low, a compressor 10 having the control valve 60 of FIGS. 4 and 5 is ready to operate at a large displacement. When the vehicle is accelerated or when the automatic transmission is in an economy mode, the target suction pressure Pset is switched to the value Pset1. In this state, even if the cooling load is great and the suction pressure Ps is relatively high, the compressor 10 is not easily switched to the large displacement mode.

Figure 5:
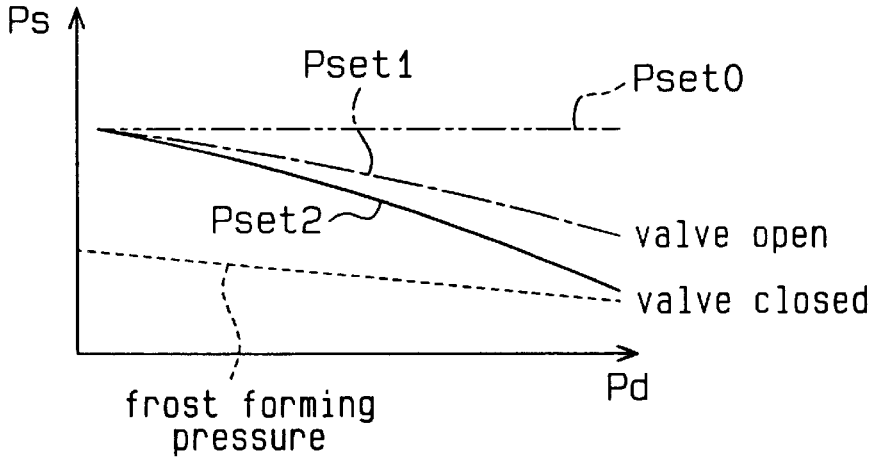
FIG. 5 is a graph showing the relationship between target pressure and discharge pressure.

Thus, the compressor 10 of FIGS. 4 and 5 has the same advantages (1) to (7) as the compressor 10 of FIGS. 1 to 3.

Figure 6:
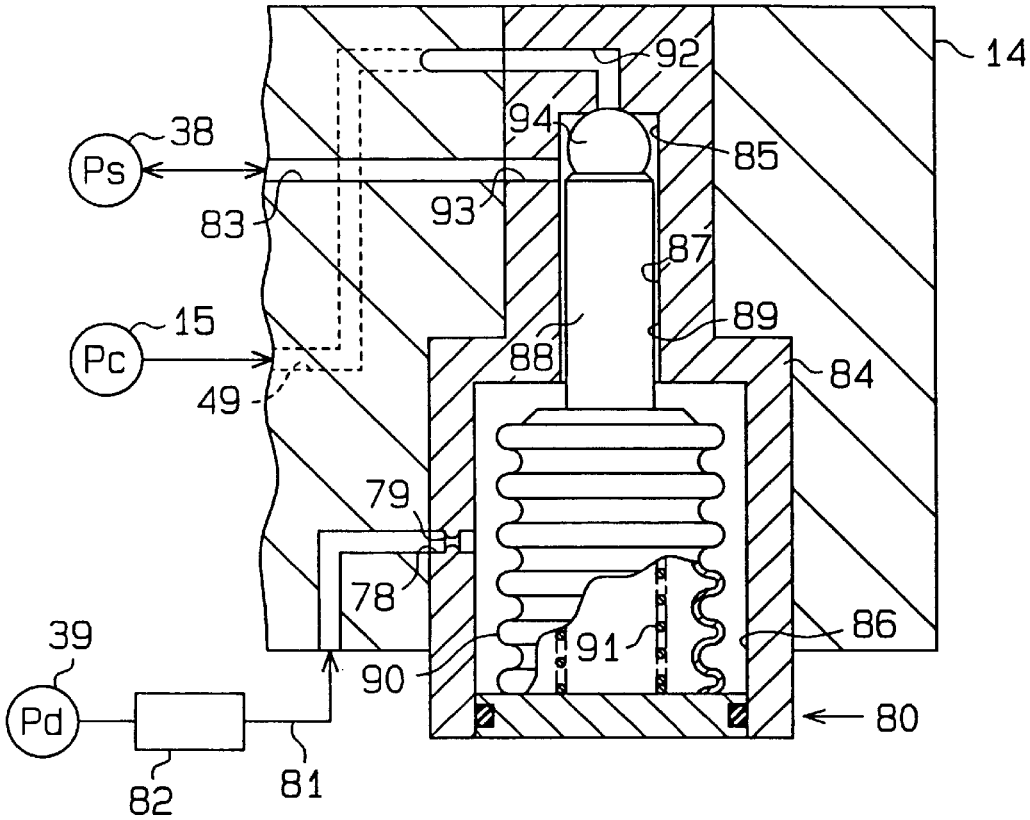
FIG. 6 is an enlarged partial cross-sectional view illustrating a control valve according to a third embodiment.
Figure 7:
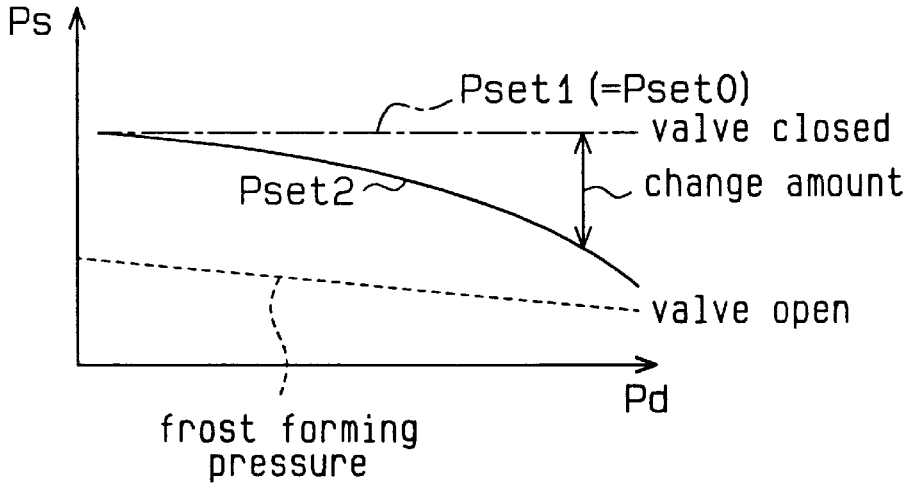
FIG. 7 is a graph showing the relationship between target pressure and discharge pressure.

A swash plate type variable displacement compressor according to a third embodiment will now be described with reference to FIGS. 6 and 7. The compressor (not fully illustrated) of FIGS. 6 and 7 is similar to the compressor 10 of FIGS. 1 to 3 except for the following points. The compressor of FIGS. 6 and 7 does not have the bleeding passage formed by the shutter chamber 27, the hole 47 and the passage 46, and it has a different control valve 80. Unlike the previous two embodiments, the control valve 80 releases refrigerant gas from the crank chamber 15 to the suction chamber 38. The compressor 10 of FIGS. 1 to 3 has the electromagnetic valve 51 to control the amount of gas released from a pressure sensing chamber 63. The compressor of FIGS. 6 and 7 has an electromagnetic valve 82 to control the amount of gas delivered to the pressure sensing chamber 86. Therefore, like or the same reference numerals are given to those components that are like or the same as the corresponding components of FIGS. 1 to 3.

As shown in FIG. 6, the control valve 80 is located in the rear housing 14. The valve 80 is connected to the discharge chamber 39 by an inlet passage 81. An electromagnetic flow control valve 82 is located in the inlet passage 81 to regulate the flow of highly pressurized gas from the discharge chamber 39 to the pressure sensing chamber 86. In this embodiment, the displacement control passage is a bleeding passage and it has a first part 83, a second part 49, and it includes a valve chamber 85. The control valve 80 is connected to the crank chamber 15 by a second part 49 of the displacement control passage and is connected to the suction chamber 38 by a first part 83 of the displacement control passage. As each piston 36 reciprocates, highly pressurized gas (blowby gas) is constantly supplied to the crank chamber 15 through the clearances between the pistons 36 and the cylinder bores 11*a*.

The control valve 80 includes a valve housing 84. A valve chamber 85 is defined in the upper portion of the valve housing 84. A pressure sensing chamber 86 is defined in the lower portion of the valve housing 84. A rod guide 87 is defined between the valve chamber 85 and the pressure sensing chamber 86. The rod guide 87 supports a rod 88 such that the rod 88 slides axially. An outlet passage 89, which is formed by a clearance between the rod guide 87 and the rod 88, connects the valve chamber 85 with the pressure sensing chamber 86.

A bellows 90, is located in the pressure sensing chamber 86. The pressure in the bellows 66 is vacuum pressure or an extremely low pressure. A bellows spring 91 is located in the bellows 90. The bellows spring 91 expands the bellows 90 thereby causing the upper end of the bellows 90 to contact the lower end of the rod 88. The bellows 90 and the bellows spring 91 define a pressure sensing mechanism of the control valve 80.

An inlet hole 78 is formed in the wall of the valve housing 84. The inlet hole 78 connects the pressure sensing chamber 86 with the inlet passage 81. Also, the inlet hole 78 has a fixed restrictor 79.

The valve housing 84 also has an upper passage 92. The upper passage 92 opens to the ceiling of the valve chamber 85. A radial hole 93 is formed in the valve housing 84 to open to the valve chamber 85. The upper passage 92 is connected with the second part 49 of the displacement control passage. The radial hole 93 is connected with the first part 83 of the displacement control passage.

A spherical valve body 94 is located in the valve chamber 85. The valve body 94 contacts the upper end of the rod 88 and is urged in a direction to close an opening formed in the upper end of the valve chamber 85. The valve body 94 selectively connects the valve chamber 85 with the crank chamber 15. The valve chamber 85 is always connected to the suction chamber 38.

The valve chamber 85 is connected to the suction chamber 38 and to the crank chamber 15 such that the difference between the suction pressure Ps and the crank chamber pressure Pc urges the valve body 94 in the opposite direction from that in which the bellows spring 91 urges the rod 88.

When de-excited, the electromagnetic valve 82 closes the inlet passage 81 to stop the flow of highly pressurized gas from the discharge chamber 39 to the pressure sensing chamber 86. When excited, the electromagnetic valve 82 opens the inlet passage 81 and permits gas flow from the discharge chamber 39 to the pressure sensing chamber 86. The electromagnetic valve 82 is controlled by the controller 70. In normal state, the controller 70 de-excites the electromagnetic valve 82 and closes the inlet passage 81.

The operation of the control valve 80 will now be described.

The pressure sensing chamber 86 is constantly exposed to the suction pressure Ps through the first part 83 of the displacement control passage, the valve chamber 85 and the outlet passage 89. The pressure Pk of the pressure sensing chamber 86 is therefore substantially determined by the suction pressure Ps. The opening amount of the valve chamber 85 is determined by the expansion of the bellows 90. The expansion of the bellows 90 is determined by the pressure Pk of the pressure sensing chamber 86 and the force of the bellows spring 91.

When the suction pressure Ps increases and the pressure Pk of the pressure sensing chamber 86 exceeds the target suction pressure Pset, the bellows 90 contracts against the force of the bellows spring 91. Then, the bellows 90 causes the valve body 94 to open the valve chamber 85. Accordingly, gas is discharged to the suction chamber 38 from the crank chamber 15 through the valve chamber 85.

When the suction pressure Ps decreases and the pressure Pk falls below the target suction pressure Pset, the bellows 90 is expanded by the force of the bellows spring 91. The bellows 90 then causes the valve body 94 to close the valve chamber 85 thereby stopping gas flow from the crank chamber 15 to the suction chamber 38.

As described above, the pressure sensing chamber 86 is connected to the suction chamber 38 through the outlet passage 89. Thus, when the electromagnetic valve 82 is closed, the pressure Pk of the pressure sensing chamber 86 is substantially equal to the suction pressure Ps. Therefore, the target suction pressure Pset when the electromagnetic valve 82 is closed is equal to the target suction pressure Pset0, which is determined by the force of the bellows spring 91. For example, as shown in FIG. 7, the target suction pressure Pset1 is substantially constant regardless of the discharge pressure Pd.

When the electromagnetic valve 82 is opened, highly pressurized gas is supplied to the pressure sensing chamber 86 from the discharge chamber 39, which causes the pressure Pk to be higher than the suction pressure Ps. Therefore, the target suction pressure Pset2, which applies when the electromagnetic valve 82 is open, is lower than the target suction pressure Pset0 as shown in FIG. 7. The target suction pressure Pset2 decreases as the discharge pressure Pd increases.

Operation of a compressor having the control valve 80 of FIG. 6 will now be described.

Refrigerant gas is drawn into the suction chamber 38 from the external refrigerant circuit 54. When the passenger compartment temperature is relatively high, the suction pressure Ps increases. If the increased suction pressure Ps exceeds the target suction pressure Pset, the bellows 90 contracts. Accordingly, the valve body 94 is moved downward, which permits gas to flow from the crank chamber 15 to the suction chamber 38 through the valve chamber 85. The crank chamber pressure Pc decreases despite the blowby gas flowing from the cylinder bores 11*a*. As a result, the back pressure of the pistons 36 (the crank chamber pressure Pc) decreases. Accordingly, the inclination of the swash plate 23 and the stroke of the pistons are increased. The compressor displacement is increased accordingly.

When the passenger compartment temperature is relatively low, the suction pressure Ps falls below the target suction pressure Pset. In this case, the bellows 90 expands and lifts the valve body 94, which closes the opening of the valve chamber 85. Accordingly, refrigerant gas cannot flow from the crank chamber 15 to the suction chamber 38. The crank chamber pressure Pc, or the back pressure of the pistons 36, is increased by the blowby gas. Therefore, the inclination of the swash plate 23 and the piston stroke decrease, which decreases the compressor displacement.

A compressor having the control valve 80 of FIGS. 6 and 7 has the advantages (1) to (4), (6) and (7). Further, the compressor of FIGS. 6 and 8 has the following advantages.

(8) The amount of gas flow from the crank chamber 15 to the suction chamber 38 is controlled by the control valve 80, which is located in the displacement control passage. The target suction pressure Pset in the pressure sensing chamber 86 of the control valve is switched between the value Pset1 and the value Pset2 to control the crank chamber pressure Pc. Therefore, unlike the first and second embodiments of FIGS. 1 to 5, a compressor having the control valve 80 does not need the axial passage 46 formed in the drive shaft 16 or the hole 47 in the shutter 30, which together form a bleeding passage. The manufacturing process is thus simplified.

A swash plate type variable displacement compressor according to a fourth embodiment will now be described with reference to FIG. 8. The compressor of FIG. 8 (not fully illustrated) is basically the same as the compressor of FIGS. 6 and 7. The compressor of FIGS. 6 and 7 has the electromagnetic valve 82 to control the amount of highly pressurized gas flowing from the discharge chamber 39 to the pressure sensing chamber 86. The compressor of FIG. 8 does not have such an electromagnetic valve 82. Instead, the compressor of FIG. 8 has an electromagnetic valve 51 to control the amount of gas released from the sensing chamber 86. Like or the same reference numerals are given to those components that are like or the same as the corresponding components of FIGS. 6 and 7.

Figure 8:
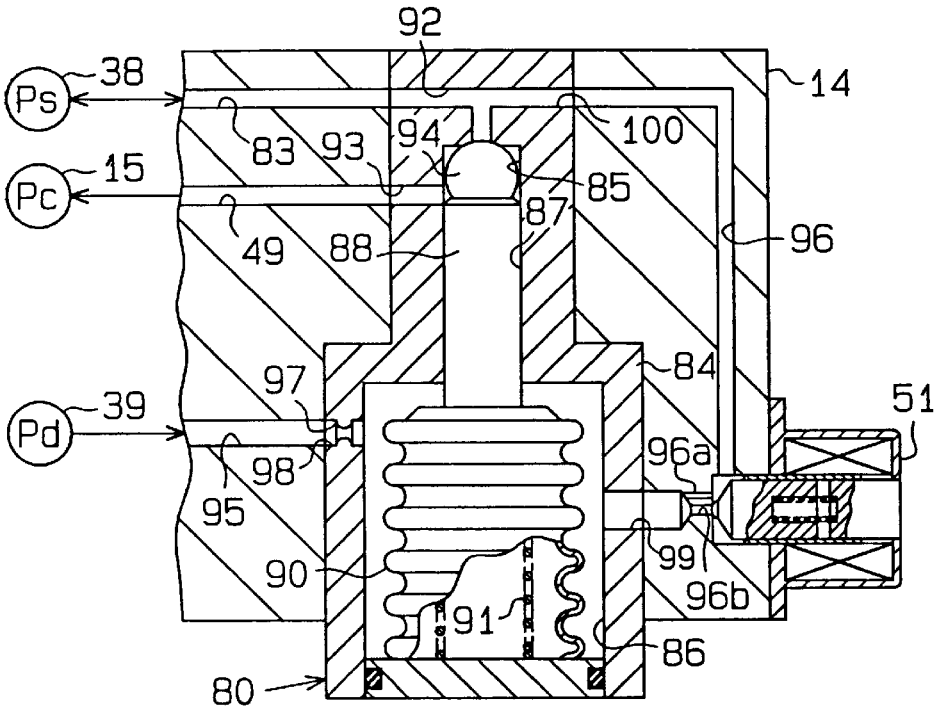
FIG. 8 is an enlarged partial cross-sectional view illustrating a control valve according to a fourth embodiment.

As shown in FIG. 8, the housing 84 of the control valve 80 is located in the rear housing 14 of the compressor. The valve housing 84 has an inlet port 98. The inlet port 98 has a fixed restrictor 97 and is connected with the pressure sensing chamber 86. The pressure sensing chamber 86 is connected to the discharge chamber 39 through the inlet port 98 and an inlet passage 95.

An outlet port 99 is formed in the housing 84 to connect with the pressure sensing chamber 86. An outlet passage 96, 100 connects the sensing chamber 86 with the suction chamber 38. The outlet passage has an upper part 100 and a lower part 96. The outlet port 99 is connected to the outlet passage 96, 100. The upper passage 92 therefore connects the outlet passage 96, 100 with the suction chamber 38.

An electromagnetic valve 51 is located in the rear housing 14 to regulate the outlet passage 96, 100. Specifically, the electromagnetic valve 51 selectively permits refrigerant gas to flow from the pressure sensing chamber 86 to the suction chamber 38. The outlet passage 96, 100 includes a bypass passage 96*a* and a valve passage 96*b*. The bypass passage 96*a* bypasses the electromagnetic valve 51 and serves as a fixed restrictor. The valve passage 96*b* is opened and closed by the electromagnetic valve 51.

When de-excited, the electromagnetic valve 51 closes the valve passage 96*b*. When excited, the electromagnetic valve 51 opens the valve passage 96*b*. The electromagnetic valve 51 is controlled by the controller 70. Normally, the controller 70 de-excites the electromagnetic valve 51.

The valve chamber 85 is connected to the crank chamber 15 through a radial hole 93, which is part of the displacement control passage 49, 85, 83. The valve chamber 85 is also connected to the suction chamber 38 through the upper passage 92, which is part of the displacement control passage 49, 85, 83.

The target suction pressure Pset of the control valve 80 of FIG. 8 is determined in the following manner.

The pressure Pk of the pressure sensing chamber 86 is substantially determined by the suction pressure Ps, which is constantly applied to the sensing chamber 86 through the outlet passage 100, 96. The discharge pressure Pd is applied to the pressure sensing chamber 86 through the inlet passage 95. Accordingly, the pressure Pk is higher than the suction pressure Ps.

The control valve 80 of FIG. 8 is similar to the control valve 60 of FIG. 4 in the following point. In the control valve 80, when the electromagnetic valve 51 is opened, highly pressurized gas in the discharge chamber 39 is supplied to the pressure sensing chamber 86 through the inlet passage 95 and the fixed restrictor 97. The gas is then released from the pressure sensing chamber 86 to the suction chamber 38 through the outlet passage 96*b*. As a result, the pressure Pk in the pressure sensing chamber 86 is slightly higher than the suction pressure. However, unlike the control valve 60 of FIG. 4, the difference between the suction pressure Ps and the crank chamber pressure Pc, which acts on the valve body 94, is too small to act against the force of the bellows spring 91. Therefore, when the electromagnetic valve 51 is opened, the target suction pressure Pset 1 of the control valve 80 of FIG. 8 decreases more gradually as the discharge pressure Pd increases compared to the target suction pressure Pset1 of the control valve 60 of FIG. 4.

Also, the control valve 80 of FIG. 8 is the same as the control valve 60 of FIG. 4 in the following point. That is, when the electromagnetic valve 51 is closed, refrigerant gas in the pressure sensing chamber 86 is released to the suction chamber 38 only through the bypass passage 96*a*, which serves as a fixed restrictor. Accordingly, the pressure Pk is higher than the suction pressure Ps. However, unlike the control valve 60 of FIG. 4, the difference between the suction pressure Ps and the crank chamber pressure Pc, which acts on the valve body 94, is too small to act against the force of the bellows spring 91. Therefore, when the electromagnetic valve 51 is closed, the target suction pressure Pset 2 of the control valve 80 of FIG. 8 decreases more gradually as the discharge pressure Pd increases compared to the target suction pressure Pset2 of the control valve 60 of FIG. 4.

In the compressor 10 of FIG. 8, the target suction pressure Pset is set to the value Pset 2 when the vehicle speed is constant or when the automatic transmission is in the normal drive mode. Therefore, even if the cooling load is small and the suction pressure Ps is relatively low, compressor 10 is ready to operate at a large displacement. When the vehicle is accelerated or when the automatic transmission is in an economy mode, the target suction pressure Pset is switched to the value Pset1. In this state, even if the cooling load is great and the suction pressure Ps is relatively high, the compressor 10 is not easily switched to the large displacement mode.

The compressor 10 of FIG. 8 has the same advantages (1) to (4), (6) to (8) as the compressors 10 of FIGS. 1 and 7.

The compressors of FIGS. 1 to 8 may be modified as follows.

Figure 9:
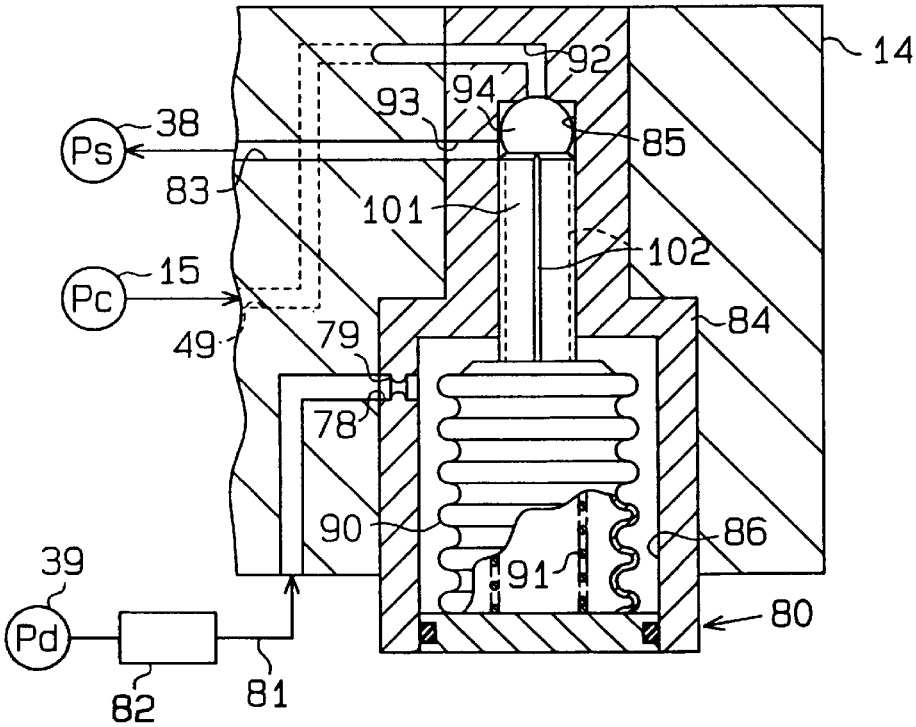
FIG. 9 is an enlarged partial cross-sectional view illustrating a control valve according to another embodiment.

In the valve 80 of FIG. 6, the clearance forming the outlet passage 89 may be replaced by grooves 102 formed on the rod 101 as shown in FIG. 9. The grooves 102 connect the valve chamber 85 with the pressure sensing chamber 86. Accordingly, the pressure sensing chamber 86 is connected to the suction chamber 38 through the valve chamber 85. In a compressor employing the valve 80 of FIG. 9, this case, the target pressures Pset1 and Pset2 have the same characteristics as those of the valve of FIGS. 6 and 7.

Figure 10:
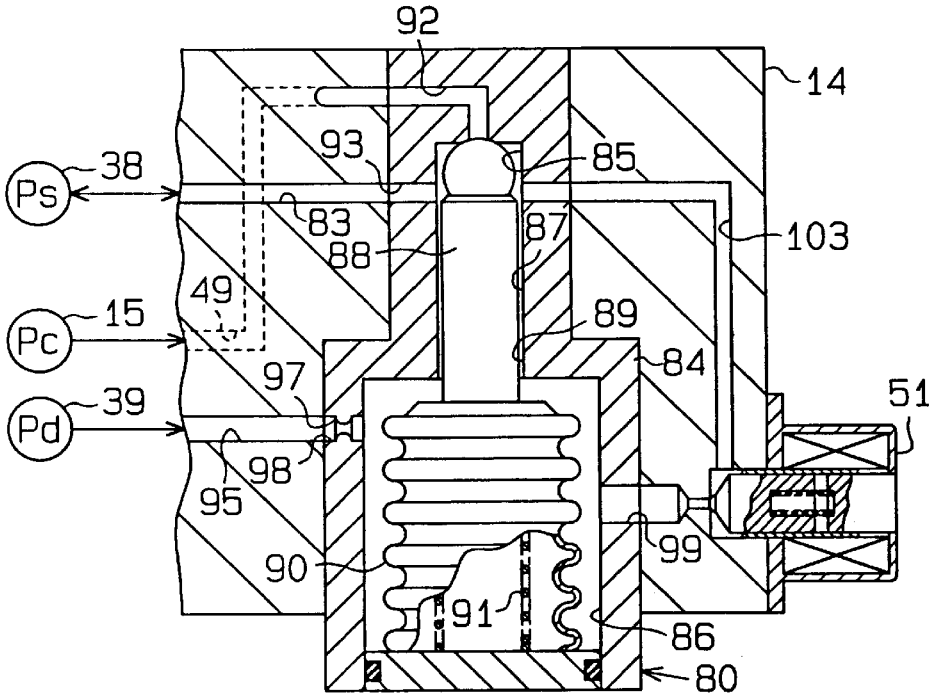
FIG. 10 is an enlarged partial cross-sectional view illustrating a control valve according to another embodiment.

The valve 80 of FIGS. 6 and 7 may be modified such that the pressure Pk in the pressure sensing chamber 86 is controlled in the manner of embodiments of FIGS. 1 to 5 and 8. In the valve 80 of FIGS. 6 and 7, the inlet passage 81 is connected to the discharge chamber 39 and the pressure Pk is controlled by the electromagnetic valve 82, which is located in the inlet passage 81. However, as shown in FIG. 10, an outlet passage 103 may be formed in the rear housing 14 to connect the pressure sensing chamber 86 to the valve chamber 85, and an electromagnetic valve 51 may be located in the outlet passage 103. The electromagnetic valve 51 regulates the gas flow between the pressure sensing chamber 86 and the suction chamber 38. The compressor of FIG. 10 is different from the compressor of FIG. 8 in the following points. The positions at which the suction chamber 38 and the crank chamber 15 are connected to the valve chamber 85 of FIG. 10 are inverted with respect to FIG. 8, and the bypass passage 96*a* is replaced with a secondary outlet passage 89, which is formed by a clearance surrounding the rod 88. Since the difference between the pressure of the suction chamber 38 and the crank chamber 15 is not very great, inverting the positions at which the suction chamber 38 and the crank chamber 15 are connected to the valve chamber 85 causes little problem. The bypass passage 96*a* and the secondary outlet passage 89 both function as a restrictor connecting the pressure sensing chamber 86 with the suction chamber 38. Therefore, in the compressor of FIG. 10, the target pressures Pset1 and Pset2 have characteristics similar to those of the compressor FIG. 8.

Figure 11:
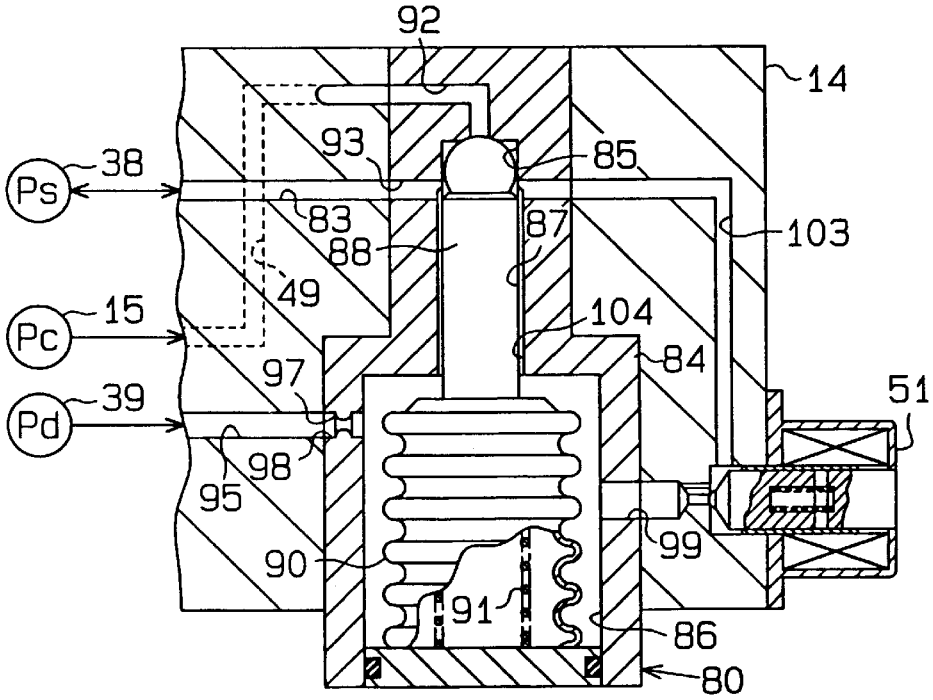
FIG. 11 is an enlarged partial cross-sectional view illustrating a control valve according to another embodiment.

The secondary outlet passage 89 of the control valve 80 shown in FIG. 10 may be replaced by grooves 104 formed in the wall of the rod guide 87 as shown in FIG. 11. Like the compressor of FIG. 10, the target pressures Pset1 and Pset2 have substantially the same characteristics as those of the compressor of in FIG. 8.

Figure 12:
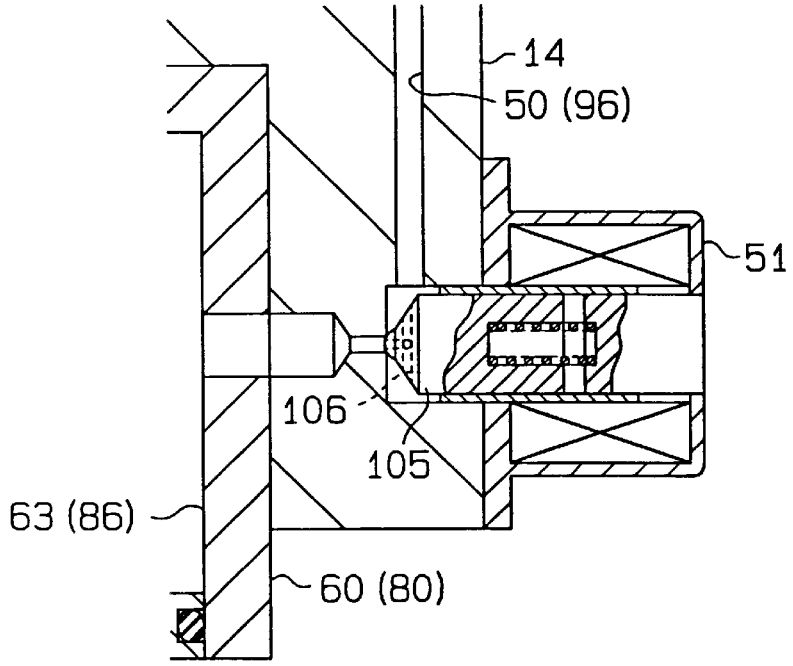
FIG. 12 is an enlarged partial cross-sectional view illustrating an electromagnetic valve according to another embodiment.

The embodiments of FIGS. 1 to 5 and 8 may be modified such that the bypass passages 50*a*, 96*a* are replaced by a passage 106 formed in the plunger (valve body) 105 of the electromagnetic valve 51 as shown in FIG. 12. The passage 106 has the same function as the bypass passages 50*a*, 96*a*. In this case, the number of passages formed in the rear housing 14 is reduced, which simplifies the manufacturing process of the compressor 10.

Figure 13:
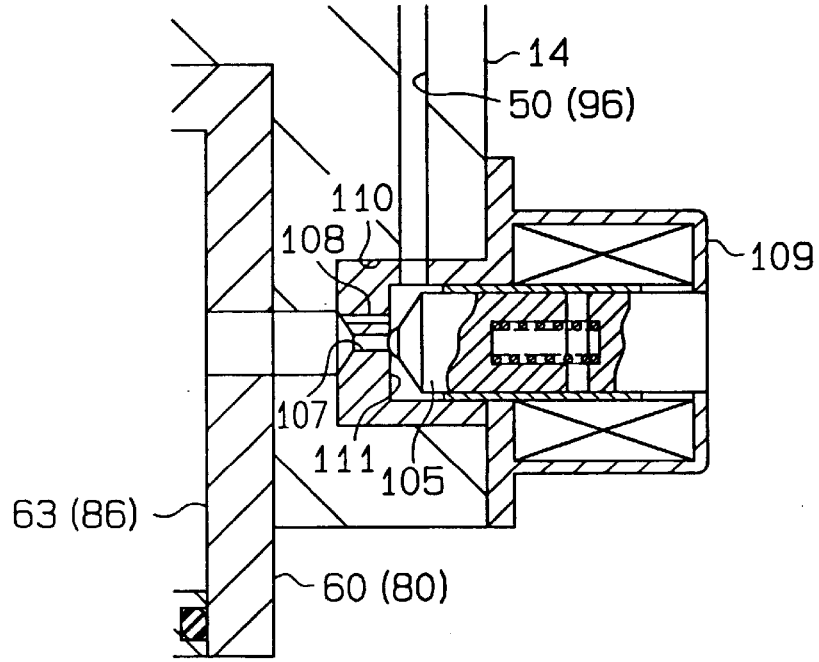
FIG. 13 is an enlarged partial cross-sectional view illustrating an electromagnetic valve according to another embodiment.

The embodiment of FIGS. 1 to 5 and 8 may be modified such that the electromagnetic valve 51 is replaced with a valve 109 illustrated in FIG. 13. The valve 109 has a chamber serving as part of the outlet passage 50, 96 and valve and bypass passages 107, 108. The valve passage 107 is opened and closed by a plunger 105. The bypass passage 108 constantly opens the outlet passage 50, 96. In this construction, the passages 50*a*, 50*b*, 96*a*, 96*b* need not be formed in the rear housing 14. Also, a valve seat 111, which contacts the plunger 105, is formed in the valve 109. Therefore, a valve seat does not need to be machined in the rear housing 14, which reduces the manufacturing steps.

In the embodiment of FIGS. 1 to 3, the inlet passage 59 between the rod guide 64 and the rod 65 may be formed by at least one groove formed on the rod 65 and at least one groove formed in the wall of the rod guide 64. The grooves connect the pressure sensing chamber 63 with the valve chamber 62. Alternatively, the pressure sensing chamber 63 may be connected to the valve chamber 62 by a passage formed in the valve housing 61 as in the valve 60 of FIG. 4.

In the embodiment of FIGS. 4 and 5, The inlet passage 77 may be replaced with an inlet passage extending through the valve body 72 and the rod 65. Such a passage connects the upper portion of the valve chamber 62 with the pressure sensing chamber 63. This construction permits highly pressurized gas in the valve chamber 62 to be drawn in to the pressure sensing chamber 63. In such an embodiment, the target pressures would Pset1, Pset2 have the same characteristics as those of the embodiment of FIGS. 4 and 5.

The embodiments of FIGS. 6, 7, 9 and 11 may be modified such that the outlet passages 89, 102 and 104 are replaced by an outlet passage formed in the valve housing 84 to connect the pressure sensing chamber 86 to the valve chamber 85.

Alternatively, the outlet passages 89, 102 and 104 may be replaced by a passage extending through the rod 88 and the valve body 94 to connect the pressure sensing chamber 86 to the valve chamber 85.

The bypass passage 96*a* of the valve 80 of FIG. 8 may be replaced by a passage extending through the rod 88 and the valve body 94 to connect the pressure sensing chamber 86 to the valve chamber 85.

In the embodiment of FIG. 8, the amount of gas released from the pressure sensing chamber 86 to the suction chamber 38 is controlled by the electromagnetic valve 51. However, like the embodiment of FIGS. 6 and 7, the electromagnetic valve 51 may be omitted and an electromagnetic valve like the electromagnetic valve 82 in FIG. 6 may be provided to regulate the amount of highly pressurized gas supplied to the pressure sensing chamber 86 from the discharge chamber 39. In this case, a passage may be formed in the valve housing 84 to connect the pressure sensing chamber 86 to the upper passage 92. Such a passage in the valve housing 84 would release gas in the pressure sensing chamber 86 to the suction chamber 38.

The control valves 60, 80 do not have to be integrated with the compressor 10.

The electromagnetic valves 51, 82 do not have to be secured to the compressor 10.

The pressure sensing chambers 63, 86 of the control valves 60, 80 may be connected to the shutter chamber 27 or to the suction passage 28.

The valve chambers 62, 85 may be connected to the shutter chamber 27 or to the suction passage 28.

The electromagnetic valves 51, 82 are switched between the open position and the closed position thereby switching the target suction pressure Pset between two values. The valves 51, 82 may be replaced by a valve that is switched to third position, or a half-open position, in addition to the open position and the closed position. In this case, the target suction pressure Pset is selected among three or more values.

The valves 51, 82 may be replaced by an electromagnetic proportional flow rate control valve to vary the target suction pressure Pset in a continuous manner.

In the illustrated embodiment, the compressor 10 is directly coupled to the engine 20 without an electromagnetic clutch in between. However, the present invention may be embodied in a compressor that is connected to an engine by an electromagnetic clutch, which selectively transmits power of the engine 20 to the compressor.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor that has a suction zone, a discharge zone, a crank chamber, a displacement control valve, and a displacement control passage, the displacement control passage being controlled by the displacement control valve to vary the pressure in the crank chamber, wherein the compressor compresses gas drawn from the suction zone and discharges the compressed gas to the discharge zone, wherein the displacement of the compressor varies according to the pressure of the crank chamber, the displacement control valve comprising:

a valve chamber for forming part of the displacement control passage;

a valve body located in the valve chamber to regulate an opening in the displacement control passage;

a pressure sensing chamber connected to the discharge zone and an associated zone whose internal pressure is held at a pressure associated with a suction pressure of the suction zone wherein gas flows into the pressure sensing chamber from the discharge zone through an inlet passage and flows out of the pressure sensing chamber to the associated zone through an outlet passage;

a pressure sensing mechanism located in the pressure sensing chamber, wherein the pressure sensing mechanism acts on the valve body to adjust the position of the valve body according to the pressure in the pressure sensing chamber; and an electromagnetic valve for regulating one of the inlet passage and the outlet passage to change the pressure of the pressure sensing chamber according to a determination based on external conditions.

2. The compressor according to claim 1, wherein the displacement control passage is connected to the discharge zone, wherein the displacement control valve has a housing accommodating a rod therein, wherein the rod is axially movable with the pressure sensing mechanism and the valve body and urges the valve body to regulate the gas flow within the displacement control passage and wherein the inlet passage is formed between the rod and the housing.

3. The compressor according to claim 1, wherein the displacement control passage is connected to the suction zone, wherein the displacement control valve has a housing accommodating a rod therein, wherein the rod is axially movable with the pressure sensing mechanism and the valve body and urges the valve body to regulate the gas flow within the displacement control passage, and wherein the outlet passage is formed between the rod and the housing.

4. The compressor according to claim 2, wherein the electromagnetic valve is located in the outlet passage.

5. The compressor according to claim 3, wherein the electromagnetic valve is located in the inlet passage.

6. The compressor according to claim 1, wherein the displacement control passage is connected with the discharge zone, wherein the displacement control valve has a housing, and wherein the inlet passage is formed entirely within the housing.

7. The compressor according to claim 1, wherein the displacement control passage is connected with the suction zone, wherein the displacement control valve has a housing, and wherein the outlet passage is formed entirely within the housing.

8. The compressor according to claim 4, wherein the outlet passage includes a bypass portion that bypasses the electromagnetic valve such that the pressure sensing chamber communicates with the suction zone.

9. The compressor according to claim 8, wherein the electromagnetic valve has a housing, and the bypass portion of the outlet passage is formed in the housing of the electromagnetic valve.

10. The compressor according to claim 1, wherein the electromagnetic valve is a proportional flow control valve that permits the position of the electromagnetic valve to be varied proportionally.

11. The compressor according to claim 1, wherein the electromagnetic valve is attached to a housing of the compressor and is independent from the displacement control valve.

12. The compressor according to claim 1, wherein the pressure sensing mechanism includes a bellows and a spring urging the bellows to extend toward the valve chamber, and wherein the bellows acts on the valve body through a rod movable axially in response to movement of the bellows.

13. The compressor according to claim 12, wherein the valve chamber is connected to the discharge zone by way of the displacement control passage such that the gas from the discharge zone applies force to the valve body, and wherein the gas from the discharge zone and the rod apply force to the valve body in the same direction.

14. The compressor according to claim 13, wherein the displacement control valve has a housing in which the rod is fitted, and wherein the inlet passage is formed between the rod and the housing.

15. The compressor according to claim 14, wherein the inlet passage is formed by a groove formed in the rod or the housing.

16. The compressor according to claim 12, wherein the valve chamber is connected to the discharge zone by way of the displacement control passage such that gas from the discharge zone applies force to the valve body, wherein the gas from the discharge zone applies force to the body in a first direction, and the rod applies force to the valve body in a second direction, and the first and second directions are opposite to one another.

17. The compressor according to claim 16, wherein the displacement control valve has a housing, and the inlet passage is formed entirely within the housing.

18. A variable displacement compressor comprising:

a suction zone;

a discharge zone;

a crank chamber;

a displacement control valve;

a displacement control passage connected to the crank chamber, the displacement control passage being controlled by the displacement control valve to vary the displacement of the compressor, wherein the compressor compresses gas drawn from the suction zone and discharges the compressed gas to the discharge zone, wherein the displacement of the compressor varies according to the pressure of the crank chamber, the displacement control valve including:

a valve chamber, wherein the valve chamber forms part of the displacement control passage;

a valve body located in the valve chamber to regulate an opening in the displacement control passage;

a pressure sensing chamber connected to the suction zone and the discharge zone, wherein gas can flow into the pressure sensing chamber from the discharge zone through an inlet passage and can flow out of the pressure sensing chamber to the suction zone through an outlet passage;

a pressure sensing mechanism located in the pressure sensing chamber, wherein the pressure sensing mechanism acts on the valve body to adjust the position of the valve body according the pressure in the pressure sensing chamber; and valve means for changing the pressure of the pressure sensing chamber according to a determination based on external conditions.

19. The compressor according to claim 18, wherein the valve means has two positions.

* * * * *